US008905782B2

(12) United States Patent
Zhao

(10) Patent No.: US 8,905,782 B2
(45) Date of Patent: Dec. 9, 2014

(54) BENDING COAXIAL ELECTRICAL CONNECTOR

(75) Inventor: Shanji Zhao, Shenzhen (CN)

(73) Assignee: Electric Connector Technology Co., Ltd., Shenzen (CN)

( * ) Notice: Subject to any disclaimer, the term of this patent is extended or adjusted under 35 U.S.C. 154(b) by 165 days.

(21) Appl. No.: 13/580,976

(22) PCT Filed: May 7, 2010

(86) PCT No.: PCT/CN2010/072519

§ 371 (c)(1),
(2), (4) Date: Aug. 24, 2012

(87) PCT Pub. No.: WO2011/137593

PCT Pub. Date: Nov. 10, 2011

(65) Prior Publication Data

US 2012/0329319 A1 Dec. 27, 2012

(51) Int. Cl.

| | |
|---|---|
| ***H01R 9/05*** | (2006.01) |
| ***H01R 43/04*** | (2006.01) |
| ***H01R 13/502*** | (2006.01) |
| *H01R 13/50* | (2006.01) |
| *H01R 4/16* | (2006.01) |

(52) U.S. Cl.

CPC ..... *H01R 9/0524* (2013.01); *H01R 9/0518* (2013.01); *H01R 13/501* (2013.01); *H01R 4/16* (2013.01); *H01R 43/04* (2013.01); *H01R 13/502* (2013.01)

USPC ..... 439/582

(58) Field of Classification Search

CPC ..... H01R 9/0518; H01R 24/40
USPC ..... 439/582, 585
See application file for complete search history.

(56) References Cited

U.S. PATENT DOCUMENTS

| | | | | |
|---|---|---|---|---|
| 5,263,877 | A * | 11/1993 | Mitani | 439/585 |
| 6,790,082 | B2 * | 9/2004 | Obayashi | 439/582 |
| 6,997,745 | B2 * | 2/2006 | Ikeda | 439/582 |
| 7,021,966 | B2 * | 4/2006 | Ikeda et al. | 439/582 |
| 7,025,598 | B2 * | 4/2006 | Ikeda | 439/582 |
| 7,025,631 | B2 * | 4/2006 | Yamane | 439/582 |

* cited by examiner

*Primary Examiner* — Felix O Figueroa
(74) *Attorney, Agent, or Firm* — Troutman Sanders LLP; Ryan A. Schneider; Daniel Sharpe

(57) ABSTRACT

A bending coaxial electrical connector has a center terminal, a dielectric body and an outer conductor wherein the cover section of the outer conductor is provided with a protrusion projecting to the tubular section by means of which a corresponding bump is stamped out from the dielectric body which is then pressed against a center conductor of the coaxial cable disposed on the connecting section so as to form a secure connection between the center conductor of the coaxial cable and the connecting section of the center terminal of the coaxial electrical connector. The electrical connector is advantageous in that the various structures described above can firmly maintain the center conductor at a predetermined position on the center terminal, so the consistency and stability of the characteristic impedance of the connection is achieved.

13 Claims, 13 Drawing Sheets

BENDING COAXIAL ELECTRICAL CONNECTOR

CROSS-REFERENCE TO RELATED APPLICATIONS

This application is a US National Stage of International Application No. PCT/CN2010/072519, filed 7 May 2010, herein fully incorporated by reference.

BACKGROUND OF THE INVENTION

1. Field of the Invention

The invention relates to coaxial connectors and particularly relates to a bending coaxial electrical connector for connecting at least two modules or IC boards so that high frequency signals can be transmitted.

2. Description of the Related Art

In the present high frequency transmission applications that involves computing or telecommunication terminals, individual module or IC boards of the terminals are normally connected via coaxial cables and coaxial electrical connectors so that modulization or function zones and/or online testability and/or easy maintenance can be realized.

In the current art, a coaxial electrical connector typical comprises an outer conductor with a tubular section for connecting and engaging a tubular portion of a complementary connecter fixed on the IC board, a dielectric body molded in the tubular section of the outer conductor, and a center conduct terminal which is fixed in position by the dielectric body and is comprised of a connecting section for connecting to the center conductor of the coaxial cable and a contact section for contacting a terminal of the complementary connector.

In order to provide a secure connection between the center terminal of the coaxial electrical connector and the center conductor of the coaxial cable, one common application is to provide a V shaped clamp as the connecting section of the center terminal that disposed in alignment with or perpendicular to the extending direction of the coaxial cable, and then soldering or mechanically fixing the center conductor to the clamp. Particularly, the center conductor can be fixed to the center terminal by pressing the outer conductor of the coaxial electrical connector and hence the dielectric, both arms of the V shaped clamp can be brought together so that the center conductor is securely fixed within the clamp.

Although coaxial electrical connector of the above mentioned structure would meet the minimum performance requirement during signal transmission, and failure of the connection between the center conductor and the connecting section of the center terminal rarely occur, in case that the center conductor of the coaxial cable is soldered on to the center terminal of the electrical connector, stable contact between the center terminal of the coaxial electrical connector and the center terminal of the complementary connector may not be achieved and the dielectric constant of the tubular section of the outer conductor may be affected due to the solder residue or other contamination particle remained at the soldering interface within the tubular section, and electrical characters, especially the RF (radio frequency character) of the connector may be degraded as a consequence. Although the residue or contamination particle could be by removed by an additional cleaning process, this further process would increase production cost and is time consuming.

In case that the center conductor is press fixed onto the center terminal, although the pressing process is somehow simple to apply and will have no obvious mechanical connection problem even if the center conductor of the coaxial cable is slightly deflected from the axial that is orthogonal to the axial of the center conductor, the electrical character, e.g. RF character of the connection can be degraded due to the deflection of the characteristic impedance when the center conductor is deflected from a predetermined center position. Moreover, the connection can be impaired when the coaxial cable is pulled or pushed by an external force which may result in instable electrical character, especially RF character of the connection. Although alignment of the press connection can be promoted to increase the precision of the connection, the precision of the assembling tool set shall be promoted which means higher cost and possible low yield.

In addition, high stability of the characters of the connection can hardly be achieved as the depth of the center conductor of the coaxial cable extended in the center terminal could not be observed as thus proper positioning of the center conductor is hardly possible.

In summary, problems may arise in several aspect of the current electrical connector, e.g. stability of electrical characters, mass production cost and feasibility of manufacturing.

SUMMARY OF THE INVENTION

In view of the problems described above, a new bending coaxial electrical connector is proposed which is novel in structure, and/or easy to manufacture, and/or having stable electrical characters, and/or without the need of soldering the center conductor to the center terminal.

According to one aspect of the invention a bending coaxial electrical connector is provided which comprises a center terminal having a connecting section for connecting the center conductor of a coaxial cable and a contacting section for contacting a terminal of a complementary connector; an outer conductor having a tubular section for engaging the complementary connector, a cover section extended from an edge of the tubular section, and a first folding section, a second folding section and a third folding section formed on the cover section for at least partially wrap around a dielectric, an insulation layer of a coaxial cable and a protection layer of the coaxial cable respectively, wherein the tubular section is designed to have one end open and the center terminal is supported by the outer conductor through the dielectric;

wherein the cover section of the outer conductor is provided with at least a protrusion projecting to the tubular section by means of which a corresponding bump is stamped out from the dielectric body which is then pressed against a center conductor of the coaxial cable disposed on the connecting section so as to form a secure connection between the center conductor of the coaxial cable and the connecting section of the center terminal of the coaxial electrical connector.

The protrusion on the cover section of the outer conductor can be formed automatically by a puncher or manually by other punch tool. The protrusion can be in the form of a cylinder or a bar, etc. By folding the outer conductor the corresponding bump is formed on the dielectric body whereby the center conductor of the coaxial cable is securely pressed against the center terminal so that a secure connection between the center conductor and the center terminal is formed. As the dielectric body is normally made of soft material, e.g., epoxy resin composite, the center conductor will not be damaged by the dielectric. In the meantime, as the dielectric body normally has good elasticity and high friction coefficient, the center conductor can be firmly hold in position in the center terminal Preferably, a projecting arc is provided on the supporting surface of the connecting section of the center terminal which particularly having an arced contour and extends through the entire width of the supporting surface. With such arrangement, the center terminal of the electrical connector can be of sufficient contact with the center conductor of the coaxial cable when the bump is stamped out from the dielectric body by the folded outer conductor.

Preferably, one end of the connecting section of the center terminal is provided with an upward extending stopping section which is arranged angular to the axial of the coaxial cable. By the arrangement of the stop section the deepest position that the center conductor of the coaxial cable extends can be defined. Since whether the coaxial cable has been assembled in position can be indicated by the stopping section, consistency of the position of the center conductor in relative to the center terminal for each connector can be achieved and thus consistency and stability on electrical characters, especially RF characters of the connection between the connector and the coaxial cable can be achieved.

In this invention, it is preferable that a center hole is provided on the connecting section of the center terminal where the center conductor is connected. As whether the center conductor of coaxial cable is assembled to the predetermined position cannot be observed from the side of the cover section previously, the hole provided can make it possible to observe from the side of the tubular section whether the center conductor of the coaxial cable is properly positioned both in the axial direction and radial direction. With such arrangement, the reliability of the connection is therefore enhanced and the stability of the electrical characters of the connection is therefore maintained.

Preferably, the dielectric body can further comprise a contacting portion for receiving the center terminal, a tubular portion inserted in the tubular section, a supporting portion for supporting the center terminal and having a positioning groove for receiving the center terminal, and a guiding portion for guiding and receiving an exposed insulating section of the coaxial cable.

The connecting section of the center terminal is provided with an attaching section for attaching the center terminal to the dielectric.

The attaching section of the center terminal is fitted into the positioning groove of the dielectric. As the attaching section is movable only along the groove, the center terminal can be assembled to the predetermined position and hence stability of the electrical characters, especially RF characters of the connection can be maintained.

Preferably, the guiding portion of the dielectric body is provided with a slope groove within which the exposed insulating layer of the coaxial cable can be held. The slope groove is wider at the upper portion and is narrower at the lower portion and the narrowest portion at the bottom is identical to the diameter of the insulating layer. By such arrangement, pressure applied on the cable can be alleviated by the engagement of the slope groove and the exposed insulating layer, therefore the reliability of the connection can be guaranteed.

The electrical connector in the present invention is advantageous in that the various structures described above can firmly maintain the center conductor at a predetermined position on the center terminal, the consistency and stability of the characteristic impedance of the connection is therefore achieved. Moreover, the connector can be easily implemented in mass manufacturing and therefore consistent quality of the connector can be achieved.

DETAILED DESCRIPTION OF PREFERRED EMBODIMENTS

The invention will be described in detail in the following text with reference to the drawings accompanied.

Figure 1:
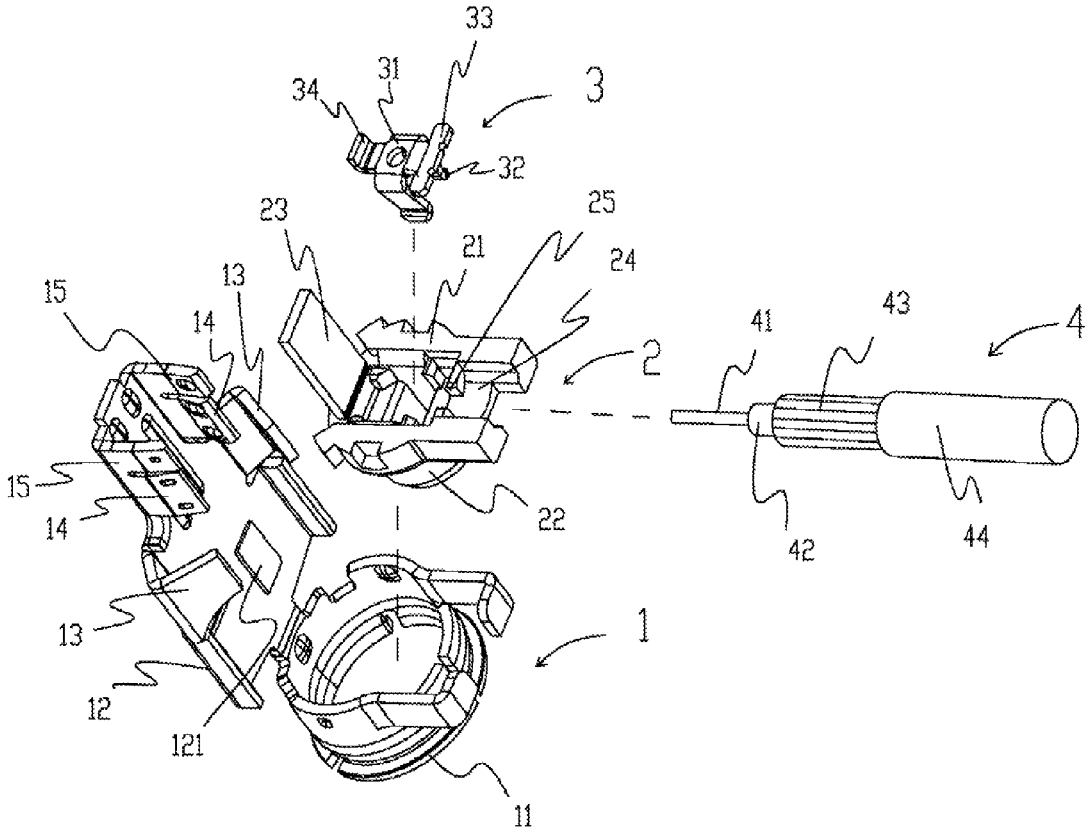
FIG. 1 is a perspective view of the components of the connector according to one embodiment of the invention.
Figure 2:
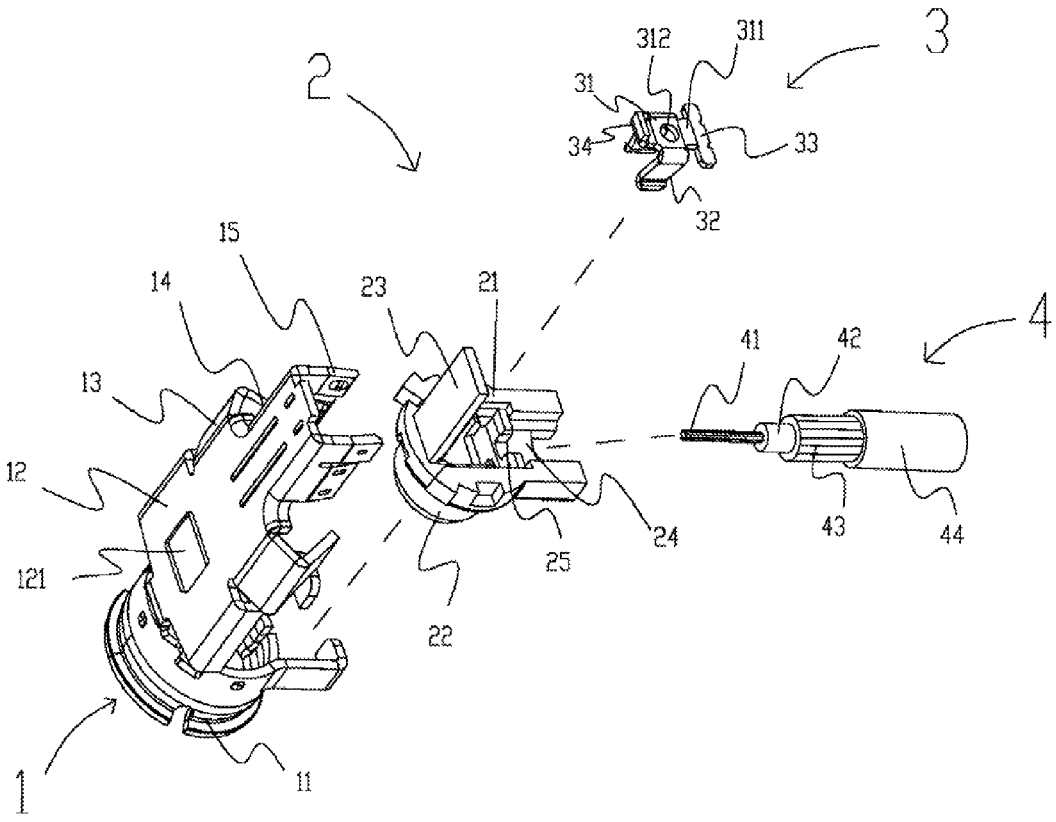
FIG. 2 is a perspective view from another angle showing the components in FIG. 1.

Referring to FIGS. 1 and 2, a bending coaxial electrical connector (or connector in short from), is shown, the connector comprising a center terminal 3 for electrically connected to the center conductor 41 of the coaxial cable 4 (or the cable in short form), an outer conductor 1 and a dielectric body 2 by which the center terminal 3 is supported.

Figure 3A:
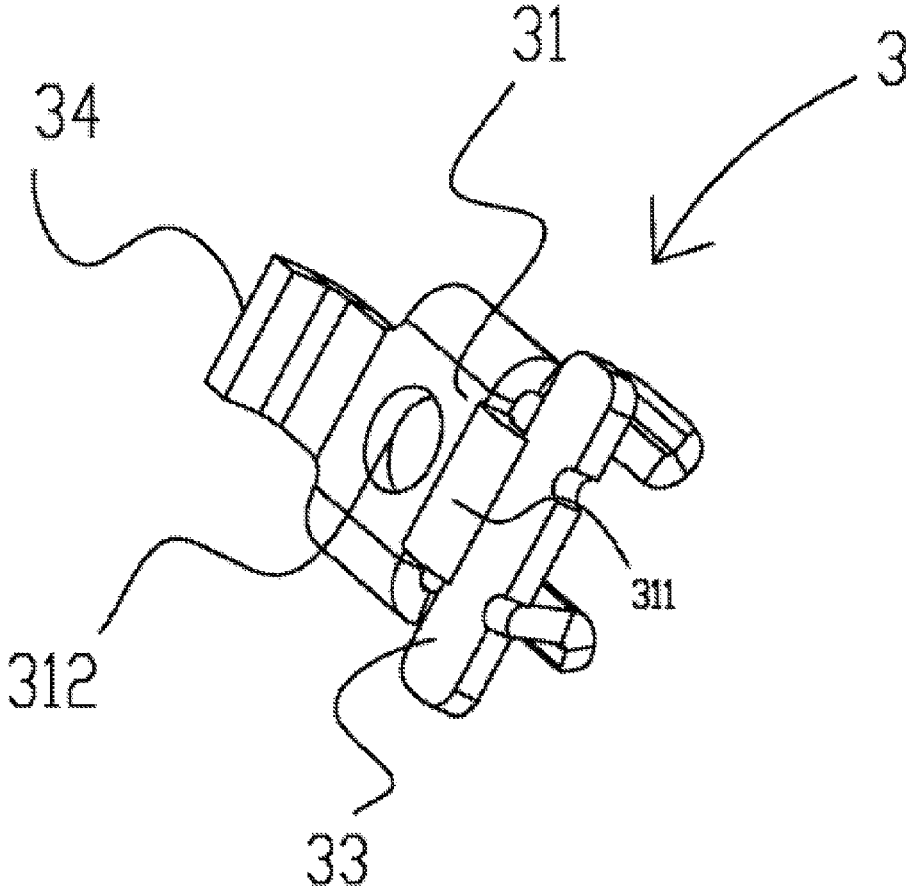
FIG. 3A shows a perspective view of the center terminal of the connector according to one embodiment of the invention.
Figure 3B:
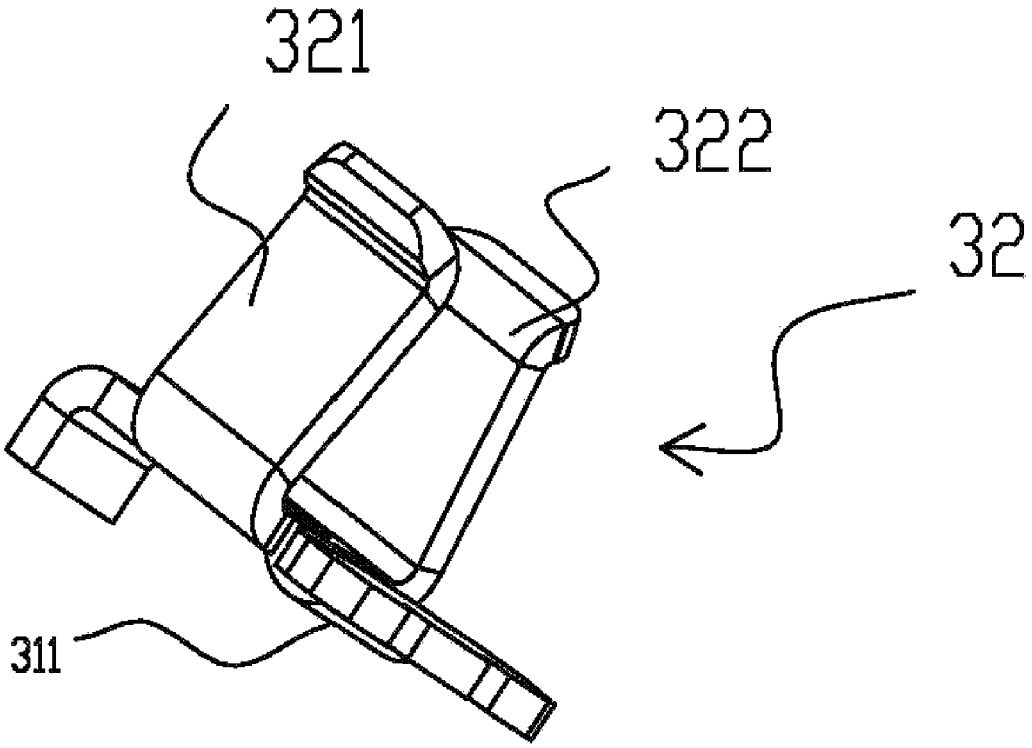
FIG. 3B shows another perspective view of the center terminal of the connector according to one embodiment of the invention.

The center terminal, which typically made of bronze, comprises as also shown in FIG. 3 A and FIG. 3B a connecting section 31 for connecting the center conductor 41, a contacting section 32 for contacting a complementary connector on the IC (not shown), and an attaching section 33, wherein the contacting section 32 is in the form of a pair of clamp arms 321, 322 extending upwards from the connecting section 31. When coupling the connector the complementary connector, the center pin of the complementary is clamped by the arms 321, 322 and a firm and stable mechanical connection is formed.

Figure 4:
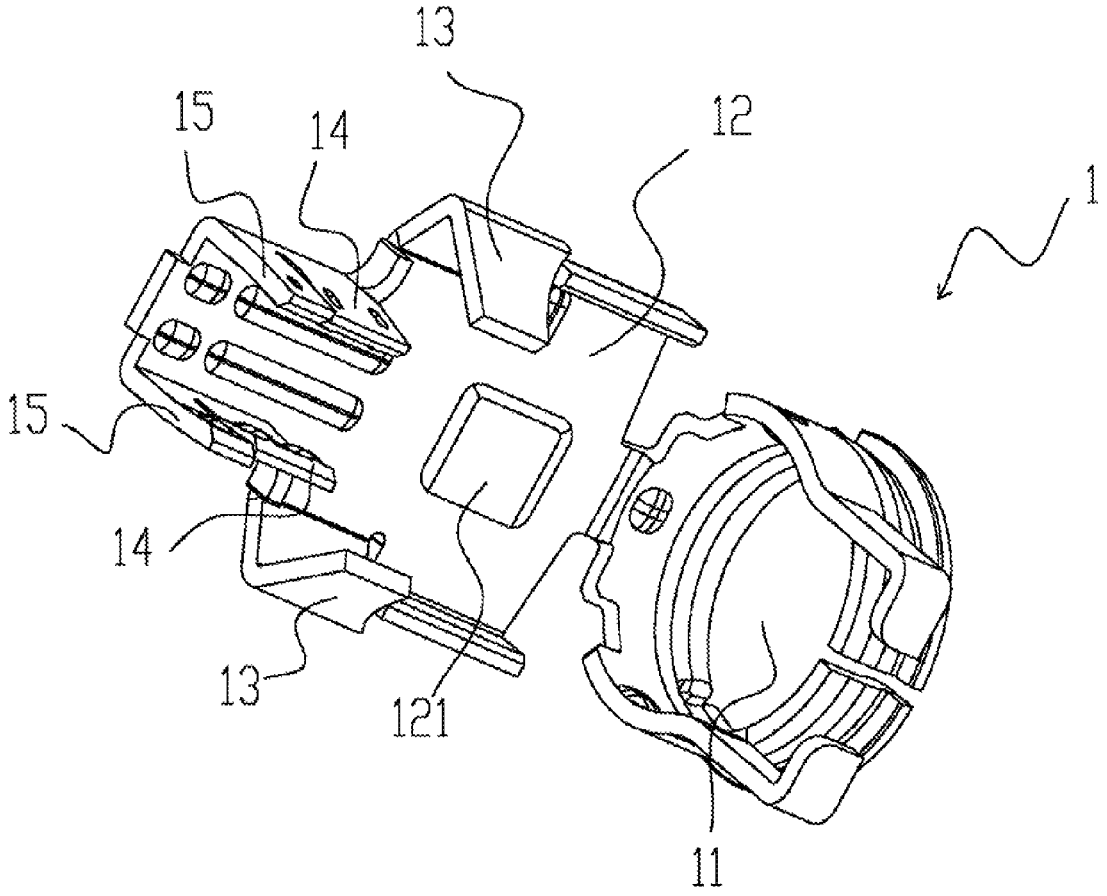
FIG. 4 is a perspective view of the outer conductor of the connector according to one embodiment of the invention.
Figure 9A:
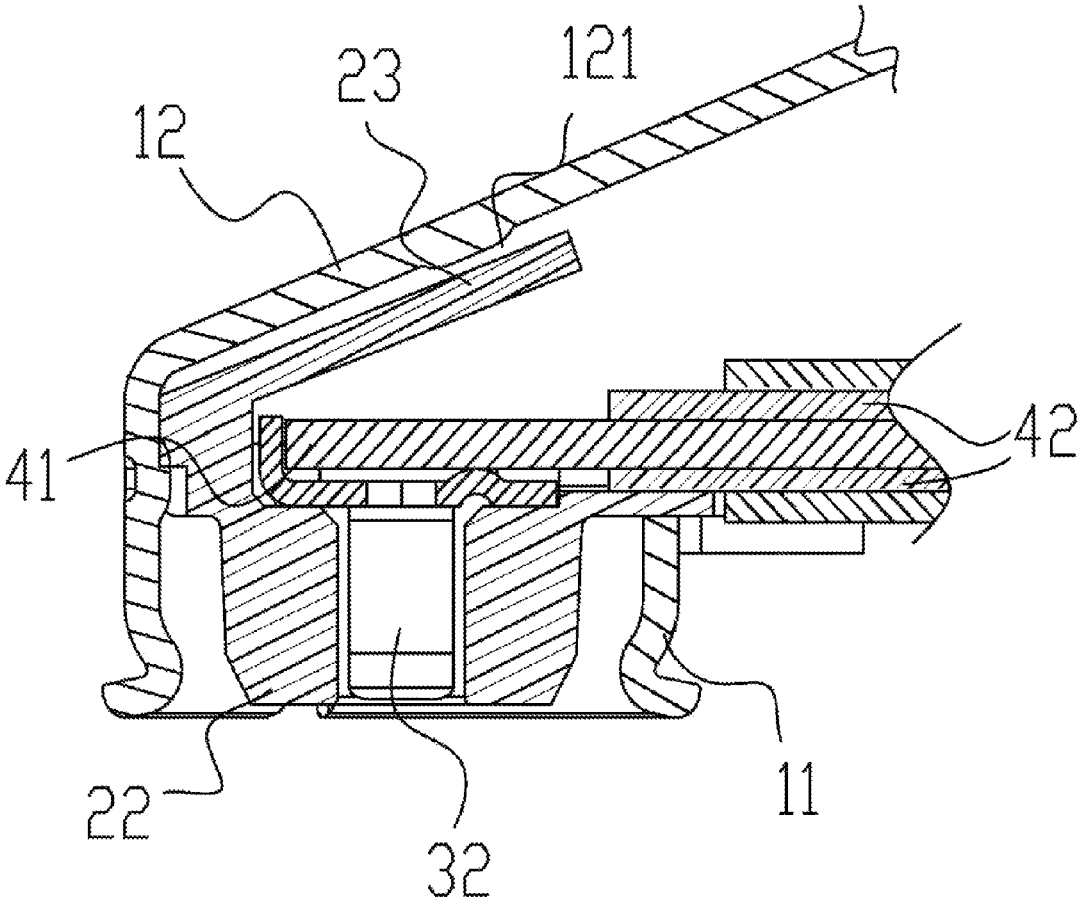
FIG. 9A is a sectional view of showing the relation of coaxial cable and the connector before folding of the cover of the outer conductor.
Figure 9B:
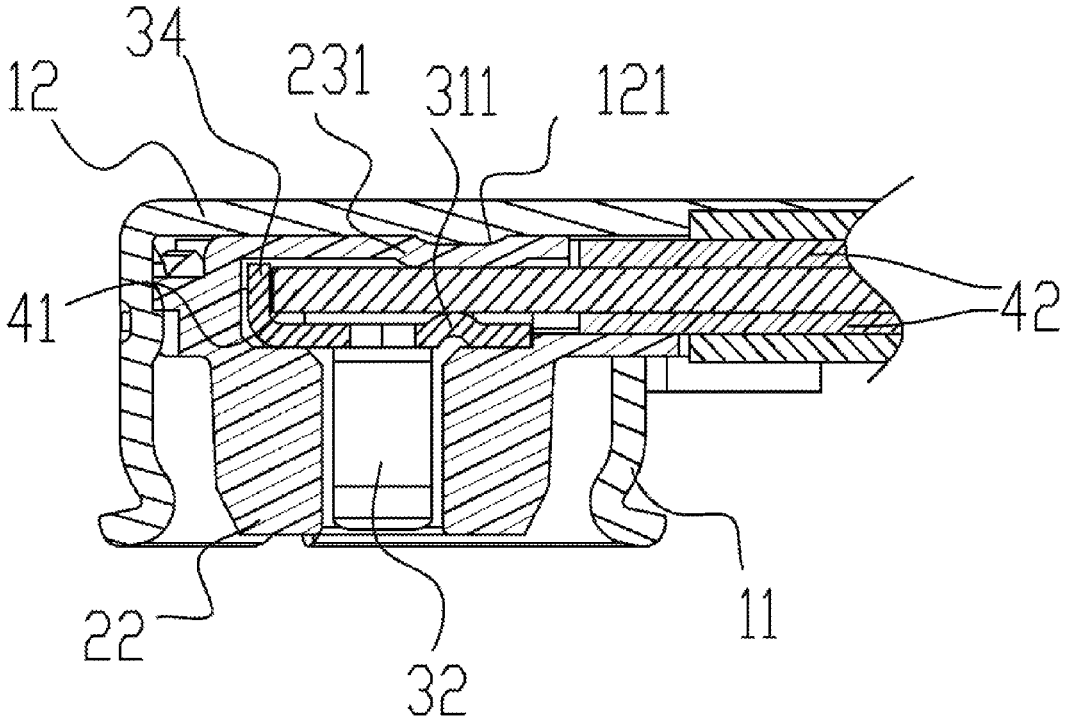
FIG. 9B is a sectional view of showing the relation of coaxial cable and the connector after folding of the cover of the outer conductor.
Figure 9C:
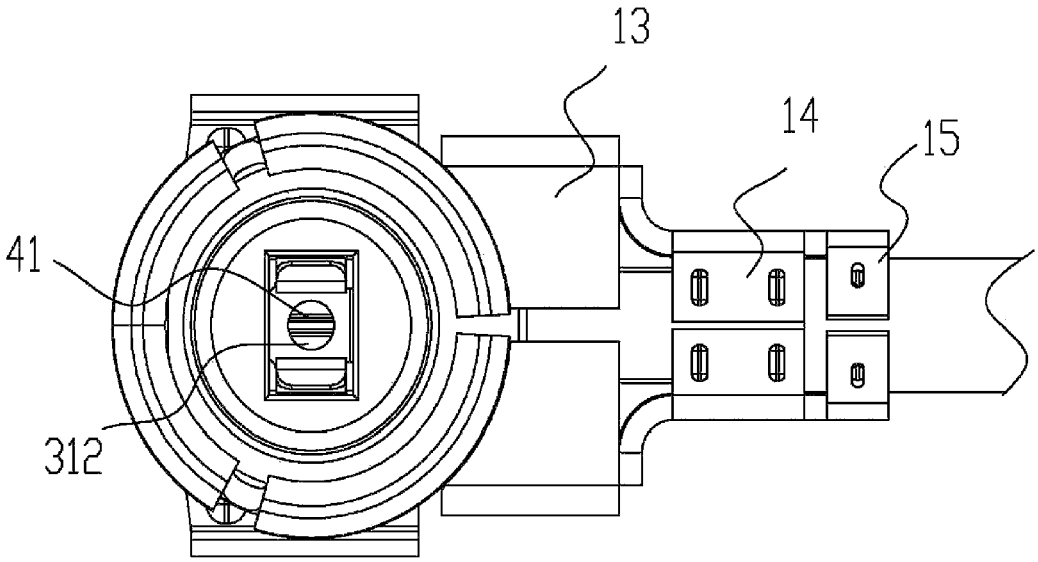
FIG. 9C is a bottom view of the assembled coaxial cable and the connector.
Figure 10:
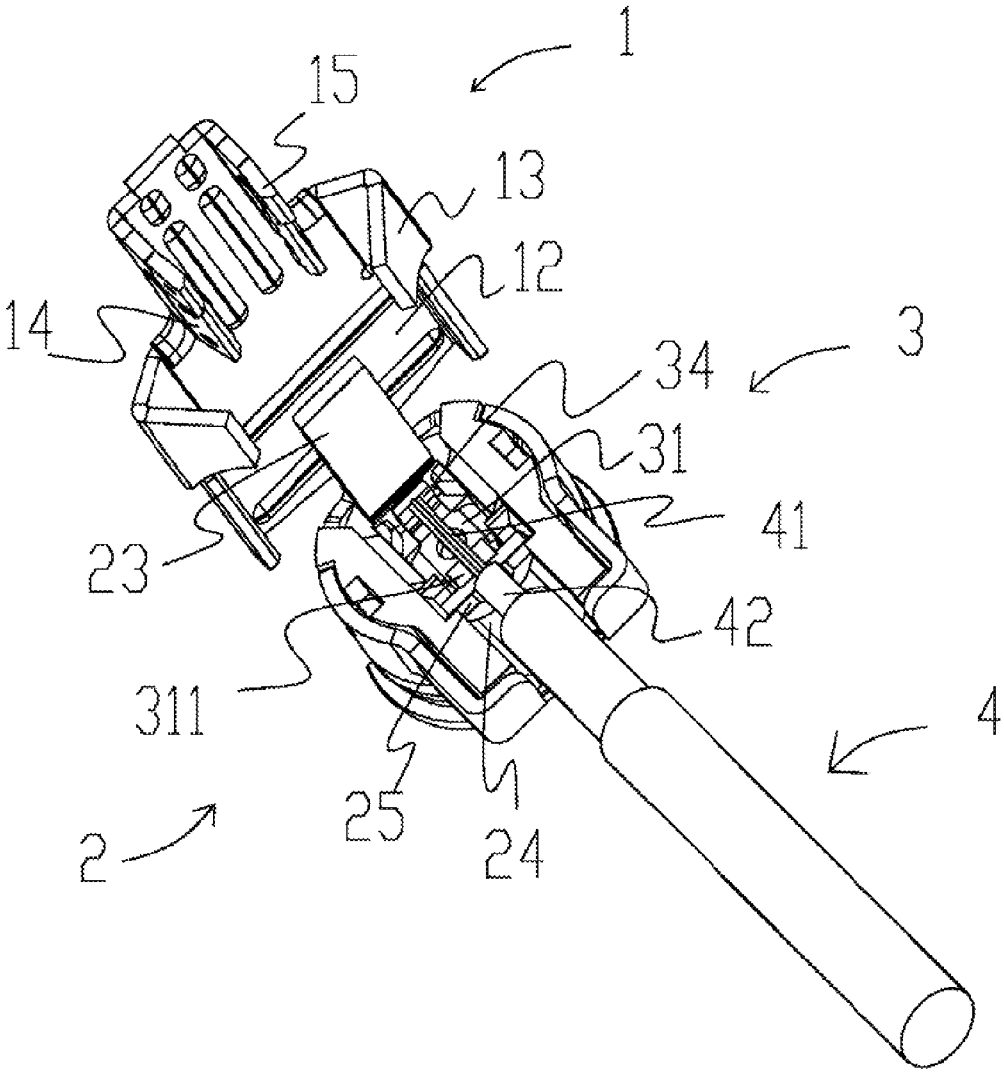
FIG. 10 is a perspective view of another embodiment of the invention.

As shown in FIG. 4, the outer conductor 1 is formed from sheet metal, particularly by punch pressing (or stamping) against progressive die. The outer conductor 1 comprises a tubular section 11 for coupling to the complementary connector, and a cover section 12 extended from a portion of the edge of the tubular section and is foldable to the tubular section to form an enclosed cavity, a free end of the cover section is provided with a firm connecting section 13, a second connecting section 14 and a third connecting section 15 for connecting and holding the dielectric body 2, the exposed insulation layer 42 of the cable 4 and the protective cover 44 of the cable 4 respectively. The cove section is further provided with a protrusion 121, which can be formed by punching by an automatic puncher or by manual tool. The protrusion can be in the shape of a square protrusion, as shown in FIG. 1 or 4, or in the shape of a bar or rib extending along the entire width of the connecting section 14, as shown in 10. A bump 231 of corresponding shape, as shown in FIGS. 9A and 9B can be formed, or stamped out from the dielectric body 2, when the cover section is folded towards the tubular section. The protrusion 121 is formed in the position that after arranging the center conductor 41 of the cable 4 on the top surface of the connecting section 31 of the center terminal 3 so that pressure can be applied to the center conductor by the protrusion 121 formed both on the outer conductor and the dielectric.

Figure 5:
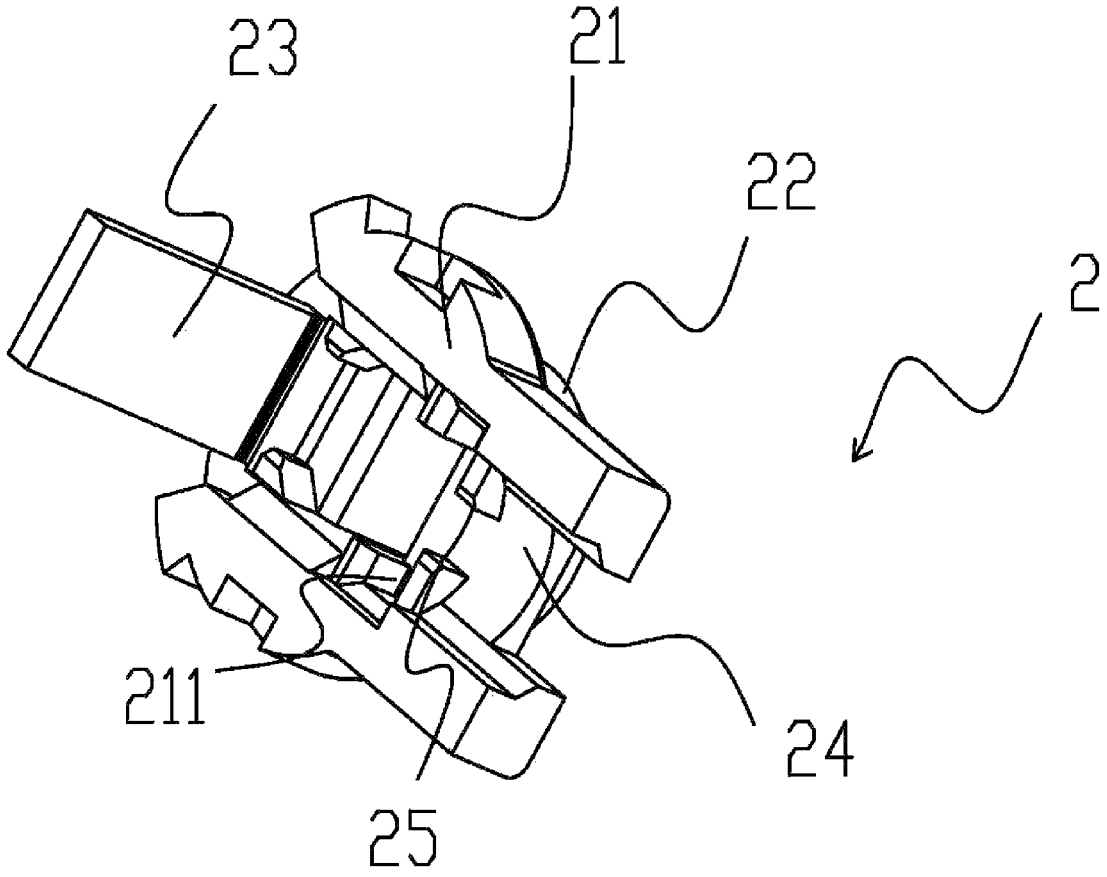
FIG. 5 is a perspective view of the dielectric body of the connector according to one embodiment of the invention.

The dielectric body 2 as shown in FIG. 5 can be injection molded against a die by melted pellets. The dielectric body 2 in this embodiment comprises a supporting portion 21, a positioning groove 211 having a substantially rectangular section for receiving the center terminal 3 and for constraining its movement, a tubular portion 22 arranged below the supporting portion 21 through which a hole is provided; a guiding portion 24 for guiding and receiving at least a portion of the exposed insulation layer 42 of the cable 4, and a slope groove arrange between the supporting portion 21 and the guiding portion 24 for limiting the lateral movement of the insulation layer 42 of the cable 4. A cantilever portion 23 can be formed on the side opposite to the side where the support portion 21 joints the guiding portion 24. This cantilever portion 23 is initially positioned orthogonal to the supporting portion 21, or in other angle relative to the supporting portion 21. The stamped bump 231 can be formed on this cantilever portion 23.

Figure 6:
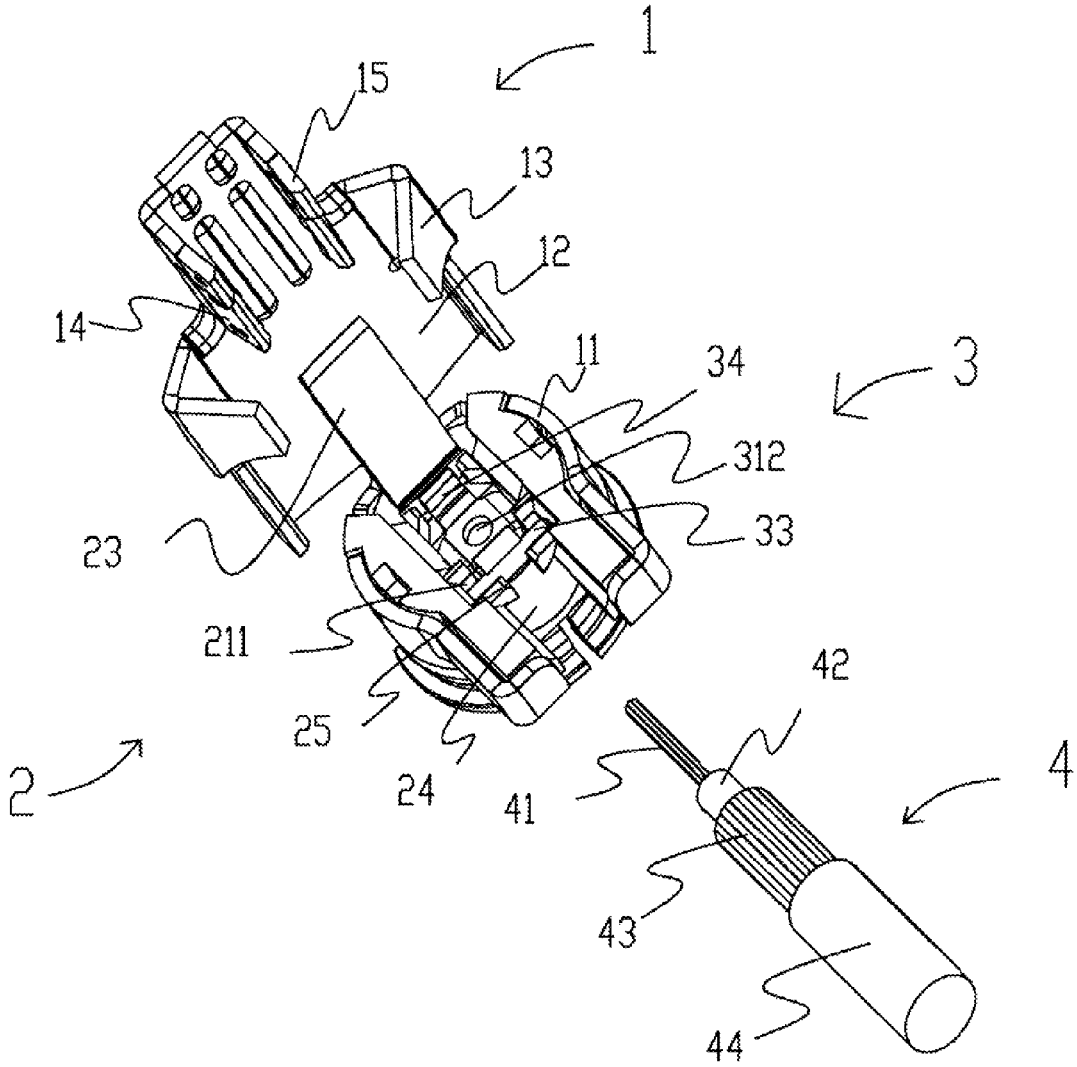
FIG. 6 is a perspective view showing an assembled connector and a coaxial cable.
Figure 7:
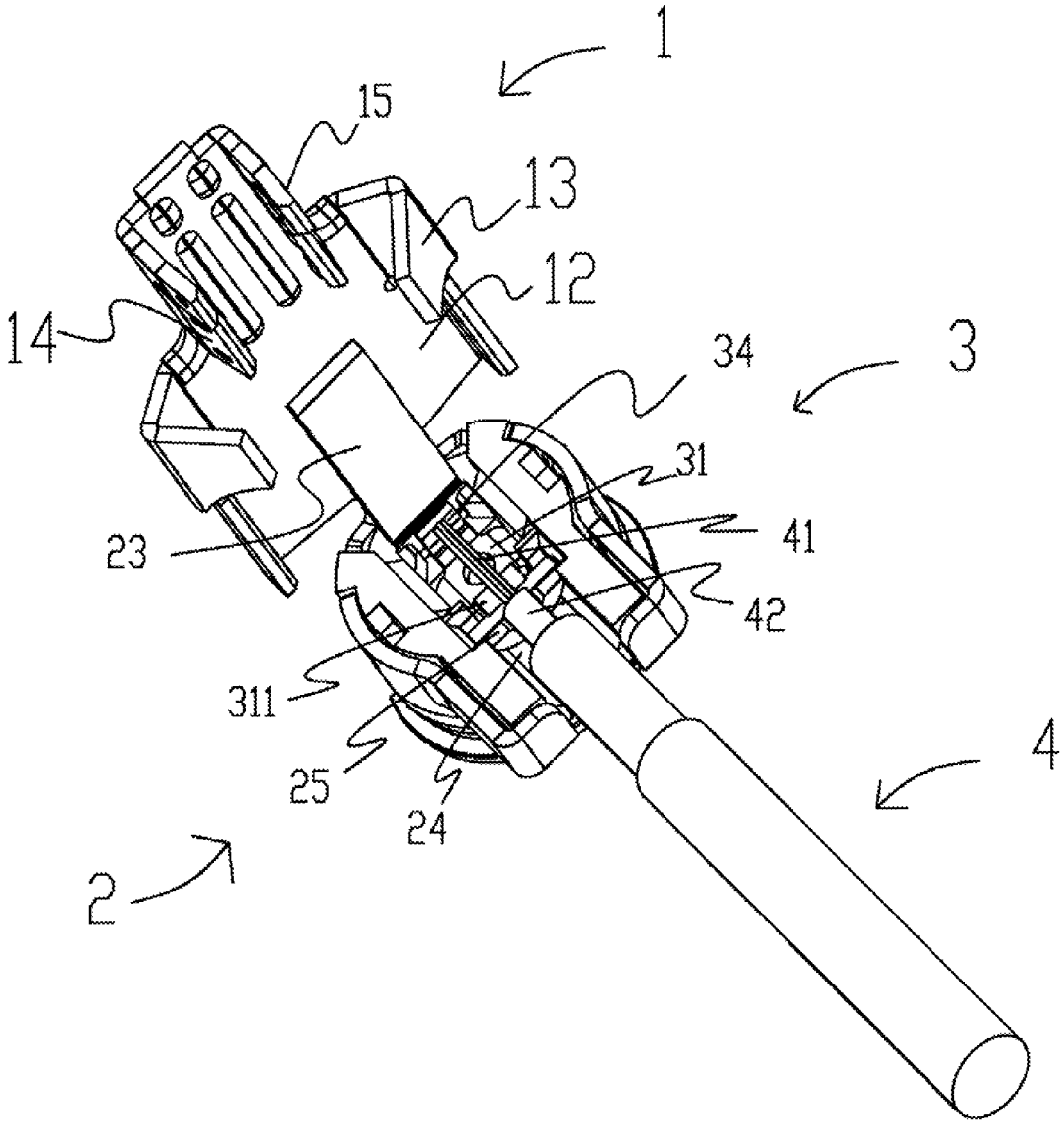
FIG. 7 is a perspective view showing the coaxial cable that has been assembled into the connector.
Figure 8:
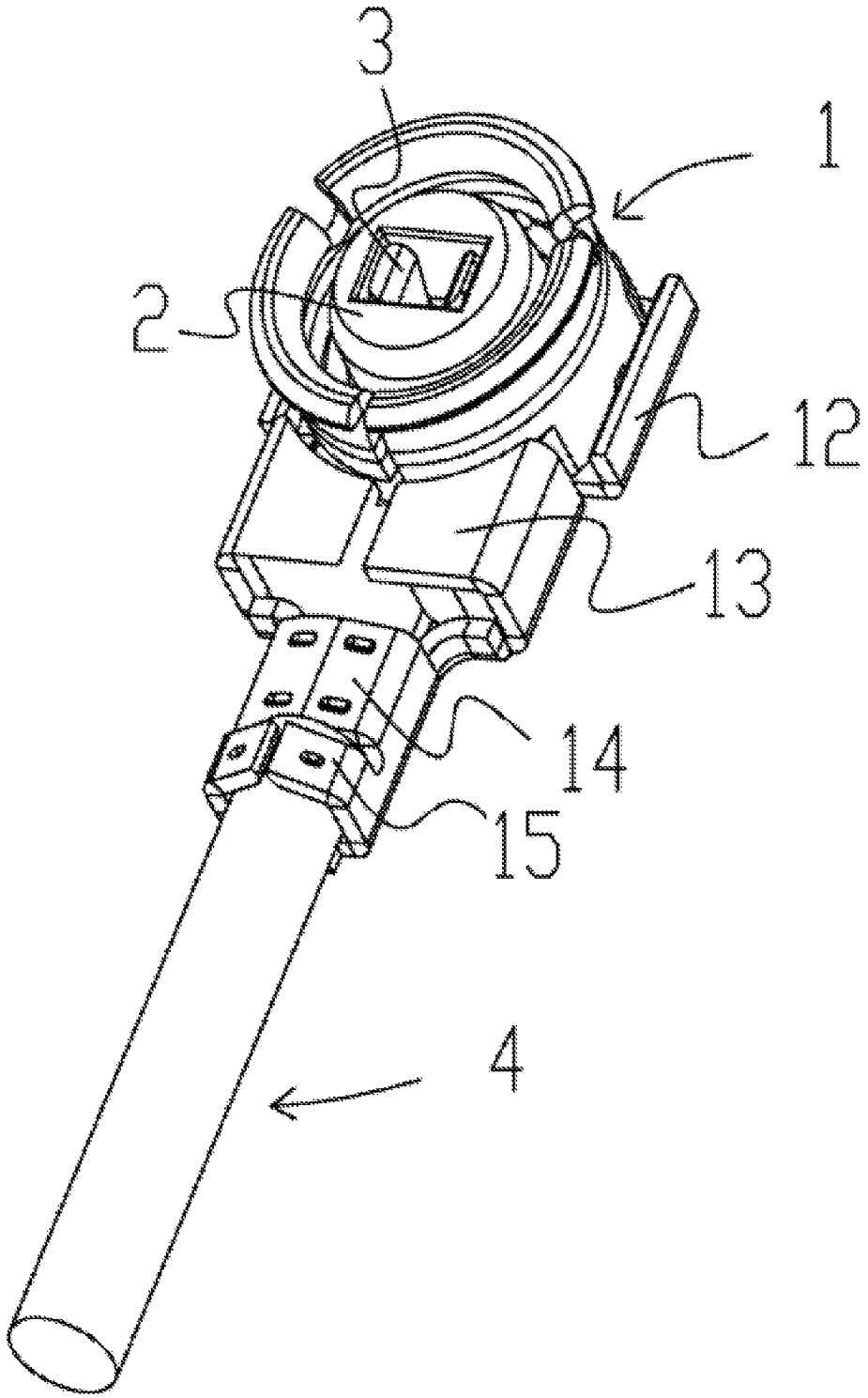
FIG. 8 is a perspective view of the assembled coaxial cable and the connector.

As shown in FIGS. 6 and 7, the center terminal is inserted into the tubular portion 22 of the dielectric body 2 with the contacting section completely nested in the hole of the tubular portion and the attaching section 33 nested in the positioning groove 211 such that the attaching section is only movable in a narrow space defined by the positioning groove 211. With such arrangement, the center terminal can be well positioned in the dielectric body and displacement of the center terminal can be avoided and stability of the electrical characters, especially RF characters of the connection can thus be maintained.

The dielectric body together with the center terminal is then inserted into the outer conductor, especially the cavity defined by the outer conductor such that the tubular portion 22 of the dielectric body 2 is completely nested in the tubular section 11 the outer conductor 1, and that the top surface of the supporting portion 21 of the dielectric body is substantially level with or slightly lower than the top surface of the tubular section 11. With such arrangement, deformation of the internal structure can be avoided when the cover section is folded towards the tubular section during subsequent assemble processes and the electrical characters, especially RF characters of the connection can thus be maintained.

The coaxial cable 4 which comprises an exposed center conductor 41, an exposed insulation layer 42, an exposed shielding layer 43, and a protective cover 44 is then coupled to the connector by placing the center conductor 41 on a predetermined position on the connecting section 31 of the connector 3. The axial depth to which the center conductor 11 extends could be determined by a further arranged stopping section 34.

By means of the guidance of a slope groove 25, a portion of the insulation layer 42 of the cable 4 will then be fitted into the slope groove 25.

The stopping section 34 can prevent the center conductor from insufficient extension or overextension of the center conductor whereby the reliability and stability of the electrical characters of the connection is achieved.

The cover section 12 is folded towards the tubular section by a pressing tool so as to close the opening of the outer connector that is opposite to the tubular section 21. During folding of the cover section the protrusion 121 provided on the cover section can stamp out a bump 231 of similar size from the cantilever portion 23 of the dielectric body 2. As can be seen from FIG. 9B, the bump 231 is formed on a position that could make it exactly pressing downwards on the location where the center conductor and the center terminal contacts. By means of the protrusion 121 and the bump 231 formed, the center conductor 41 can be firmly attached to the center terminal.

After the cover section is folded, the first folding section 13, the second folding section 14 and the third folding section 15 are then folded inward to at least partially wrap around the dielectric body 2, the insulation layer of the cable 42 and the protective cover of the cable 44 respectively, whereby the final state of the cover section is formed.

The slope groove 25 preferably having a wider upper portion and a narrower lower portion and the narrowest section at the lower portion is identical to the diameter of the exposed insulation layer 42 of the cable. As the insulation layer of the cable is clamped by the slope groove, propagation of any stress generated by any external force applied onto the cable can be alleviated or stopped by the slope groove and any impact to the connection between the center conductor 41 and the center terminal 3 can be avoided so that reliability of the connection is further guaranteed.

It is worth to mention that a projecting or projecting arc 311 can be provided on the connecting section for secure a firm connection of the connecting section with the center conductor 41 of the cable. It is preferable that the projecting arc 311 is arranged in the position that is exactly beneath the bump 231 formed on the dielectric.

Additionally, a through hole 312 is provided on the geometric center of the connecting section 31 of the center terminal 3. The position of the center conductor 41 relative to the center terminal can therefore be observed, and axial position and radial position of the center conductor can be controlled within acceptable deviation from the predetermined position as a result.

Additional advantages and modifications will readily occur to those skilled in the art. The invention is therefore in its broader aspects are not limited to the specific details and representative embodiments shown and described herein. Accordingly, various modifications may be made without departing from the spirit or scope of the general inventive concept as defined by the appended claims and their equivalents.

List of reference signs

| | |
|---|---|
| Outer Conductor | 1 |
| Dielectric Body | 2 |
| Center Terminal | 3 |
| Coaxial Cable | 4 |
| Tubular Section | 11 |
| Cover Section | 12 |
| First Folding Section | 13 |
| Second Folding Section | 14 |
| Third Folding Section | 15 |
| Supporting Portion | 21 |
| Tubular Portion | 22 |
| Cantilever Portion | 23 |
| Guiding Portion | 24 |
| Slope Groove | 25 |
| Connecting Section | 31 |
| Contacting Section | 32 |
| Attaching Section | 33 |
| Stopping Section | 34 |
| Center Conductor | 41 |
| Insulation Layer | 42 |

-continued

| List of reference signs | |
|---|---|
| Shielding Layer | 43 |
| Protective Cover | 44 |
| Protrusion | 121 |
| Positioning Groove | 211 |
| Bump | 231 |
| Projecting Arc | 311 |
| Through Hole | 312 |
| Clamp Arm | 321, 322 |

What is claimed is:

1. A bending coaxial electrical connector comprising:

a center terminal having a connecting section for connecting a center conductor of a coaxial cable, and a contacting section for contacting a terminal of a complementary connector;

an outer conductor having a tubular section for engaging the complementary connector, a cover section extending from an edge of the tubular section, a first folding section, a second folding section and a third folding section formed on the cover section for at least partially wrapping around a dielectric body, an insulation layer of the coaxial cable and a protection layer of the coaxial cable, respectively, wherein the tubular section is designed to have one end open and the center terminal supported by the outer conductor through the dielectric;

wherein the cover section of the outer conductor is provided with a protrusion projecting to the tubular section by means of which a corresponding bump is stamped out from the dielectric body which is then pressed against the center conductor of the coaxial cable disposed on the connecting section so as to form a secure connection between the center conductor of the coaxial cable and the connecting section of the center terminal of the coaxial electrical connector.

2. The connector according to claim 1, wherein the dielectric body comprises flexible resin composite.

3. The connector according to claim 1, wherein the protrusion comprises a square shape.

4. The connector according to claim 1, wherein the dielectric body further comprises a contacting portion for receiving the center terminal, a tubular portion inserted in the tubular section, a supporting portion for supporting the center terminal and having a positioning groove for receiving the center terminal, and a guiding portion for guiding and receiving an exposed insulating section of the coaxial cable.

5. The connector according to claim 4, wherein the positioning groove of the supporting portion is in a substantially rectangular shape having an opening along an axial of the coaxial cable and two closed side walls, and a dimension of the positioning groove corresponds to a dimension of the attaching section of the center terminal.

6. The connector according to claim 4, wherein the guiding portion of the dielectric body is provided with a slope groove within which the exposed insulating layer of the coaxial cable can be held.

7. The connector according to claim 4, wherein a cantilever portion is formed on a side opposite to a side where the support portion joins the guiding portion, which is initially positioned orthogonal to the supporting portion; and wherein the bump is formed on the cantilever.

8. The connector according to claim 1, wherein a projecting arc is provided on the connecting section to form a secure and firm connection of the connecting section with the center conductor of the cable.

9. The connector according to claim 8, wherein the projecting arc is arranged in the position that is beneath the bump formed on the dielectric.

10. The connector of claim 1 operated to connect a coaxial cable by a method comprising:

partially peeling off the protective cover, the shielding layer, and the insulating layer such that a portion of the center conductor, the insulating layer and the shielding layer is exposed;

coupling the center conductor of the coaxial cable into the connector such that the center conductor contacts the connecting portion of the center terminal;

pivoting the outer conductor towards the center terminal such that the bump is stamped out from the dielectric body by the protrusion on the cover portion in a shape that corresponds to the protrusion on the cover portion; and folding the first folding portion, the second folding portion and the third folding portion of the connector such that they warp around the dielectric body, the insulating layer and the protective cover of the cable, respectively.

11. The connector according to claim 2, wherein the flexible resin composite has good elasticity and a high friction coefficient.

12. The connector according to claim 1, wherein the protrusion comprises a bar shape.

13. The connector according to claim 6, wherein the slope groove is wider at the upper portion and is narrower at the lower portion and the narrowest portion at the bottom comprises the diameter of the insulating layer.

* * * * *